United States Patent [19]

Marinoni

[11] Patent Number: 4,491,355

[45] Date of Patent: Jan. 1, 1985

[54] CONTROL MECHANISM FOR HOLDING A DOOR IN THE OPEN POSITION

[75] Inventor: Mario Marinoni, Magenta, Italy

[73] Assignee: Casma di V. Mariononi & Figli, Magenta, Italy

[21] Appl. No.: 293,245

[22] Filed: Aug. 17, 1981

[30] Foreign Application Priority Data

Sep. 5, 1980 [DE] Fed. Rep. of Germany ..... 3033496

[51] Int. Cl.[3] ..... E05C 17/32

[52] U.S. Cl. ..... 292/263; 16/332; 16/334; 292/266; 403/93

[58] Field of Search ..... 292/263, 270, 278, 266, 292/269, 276, 277, 275; 16/332, 334, 344, DIG. 17; 403/92, 93, 96, 103

[56] References Cited

U.S. PATENT DOCUMENTS

| | | | |
|---|---|---|---|
| 1,478,904 | 12/1923 | Sibley | 292/275 |
| 1,535,672 | 4/1925 | Lockwood | 292/275 |
| 1,573,512 | 2/1926 | Bush | 292/275 |
| 1,587,678 | 6/1926 | Remington | 403/93 X |
| 1,829,551 | 10/1931 | Wambsgans | 403/93 |
| 2,171,065 | 9/1939 | Johnson | 292/278 |
| 2,951,723 | 9/1960 | Bernhard | 292/275 |
| 3,063,086 | 11/1962 | Calhoun | 292/275 X |
| 4,141,272 | 2/1979 | Yanagisawa | 403/92 X |
| 4,318,559 | 3/1982 | Burton | 292/263 |
| 4,363,561 | 12/1982 | Hsieh | 403/92 |

FOREIGN PATENT DOCUMENTS

| | | | |
|---|---|---|---|
| 252845 | 11/1963 | Australia | 292/263 |
| 1026277 | 2/1953 | France | 16/334 |

*Primary Examiner*—Alexander Grosz
*Assistant Examiner*—Russel W. Illich
*Attorney, Agent, or Firm*—Toren, McGeady and Stanger

[57] ABSTRACT

A control mechanism for a door including a first and a second longitudinal bar hinged together at their ends with the opposite ends of the bars being hinged, respectively, at a door and a frame. The hinge device joining together the ends of the bars includes a hinge pin with recesses on one of the bars and a spring loaded locking element on the other bar adapted to engage within the recesses for holding the door in the open position.

6 Claims, 7 Drawing Figures

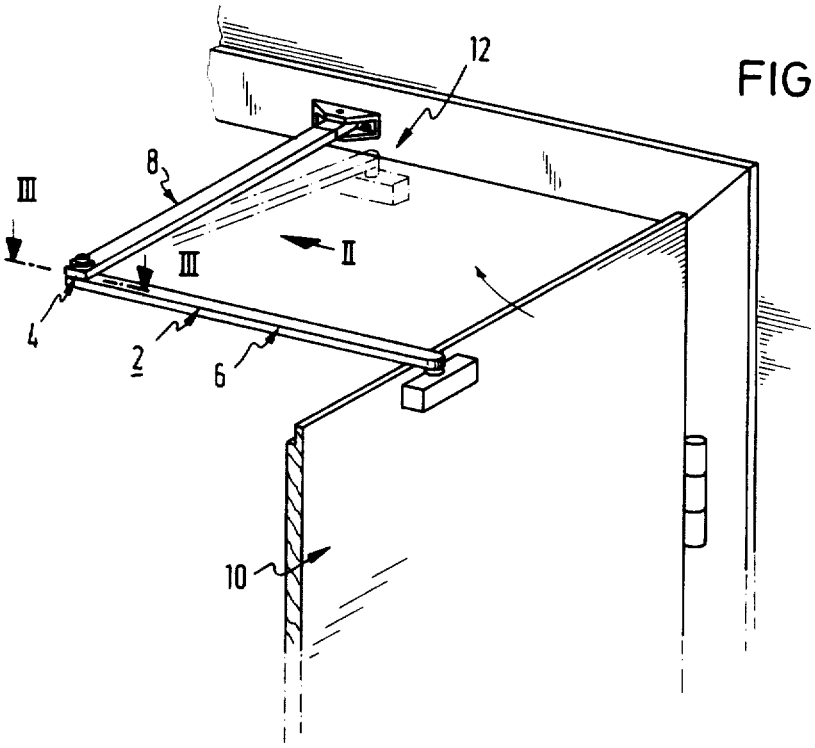
FIG. 1
FIG. 3
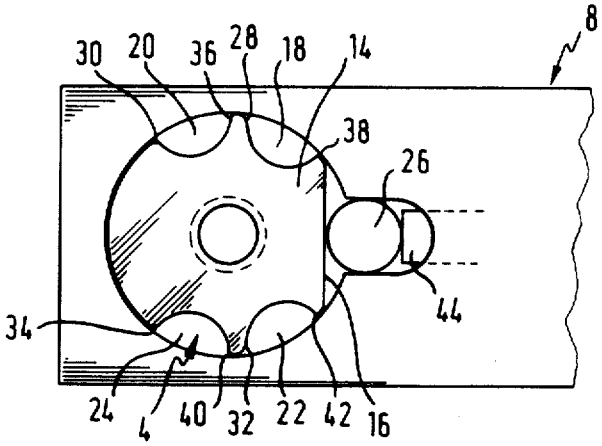

CONTROL MECHANISM FOR HOLDING A DOOR IN THE OPEN POSITION

The present invention relates generally to a door control mechanism and more specifically to a mechanism which is operative to hold a door in an open position. The door control mechanism of the invention includes a pair of longitudinal bars which are connected together at their ends by a hinge mechanism with the opposite ends of the bars being hinged, respectively, to the door and to the door frame.

The present invention is particularly directed toward provision of a door control mechanism of the type described which may be locked with simple means and which does not impair the appearance of the door control mechanism.

SUMMARY OF THE INVENTION

Briefly, the present invention may be described as a control mechanism for a door hinged on a door frame operative to hold the door in the open position comprising a first and a second longitudinal bar each having a pair of ends, hinge means joining together one of the ends of each of said bars, with the other ends of the bars being hinged, respectively, to the door frame and to the door, the hinge means joining the ends of the bars together comprising a hinge pin affixed to the first bar, at least one recess formed in said hinge pin, a locking element on the second bar adapted to engage within the recess and spring means urging the locking element into engagement with the recess.

The type of control mechanism provided by the present invention is simple to construct and does not impair the appearance of the mechanism because the hinge is installed between the two longitudinal bars.

In order to provide a mechanism whereby an opened door will not be closed unintentionally but which may also on the other hand be opened beyond its locking position without necessity for application of excessive force, the locking mechanism of the invention is preferably constructed so as to make it more difficult to move the door in the closing direction than in the opening direction.

In order to enable use of the door control mechanism of the invention with doors which close both to the left and to the right, the mechanism is preferably structured so that at least two locking recesses are provided which are arranged symmetrically with respect to a flattened area on the hinge pin.

To enable fine adjustment of the locking positions, the door closing mechanism is preferably arranged so that the hinge pin is detachably fastened on one of the longitudinal bars and secured against rotation in one of a number of different angular positions.

A particularly simple embodiment of the invention comprises a locking element which is under the pressure of a helical spring which is supported at an adjustable abutment.

In order to adapt the door control mechanism to local conditions, it is preferred that at least one of the longitudinal bars be formed with two sections which are connected together by means of a double-ended adjusting screw with oppositely directed threads which may be set by means of check nuts.

In order to enable use for the bars of the control mechanism of a material which does not require fine processing, the mechanism of the invention is preferably constructed so that the longitudinal sides of the bars are enclosed by casing elements which may be applied thereon up to the hinge pin.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE DRAWINGS

In the drawings:

FIG. 1 is a perspective view schematically depicting a door control mechanism in its installed condition;

FIG. 3 is a sectional view through a hinge at one end of the door control mechanism taken along the line III—III in FIG. 1;

DETAILED DESCRIPTION OF THE PREFERRED EMBODIMENTS

Figure 2:
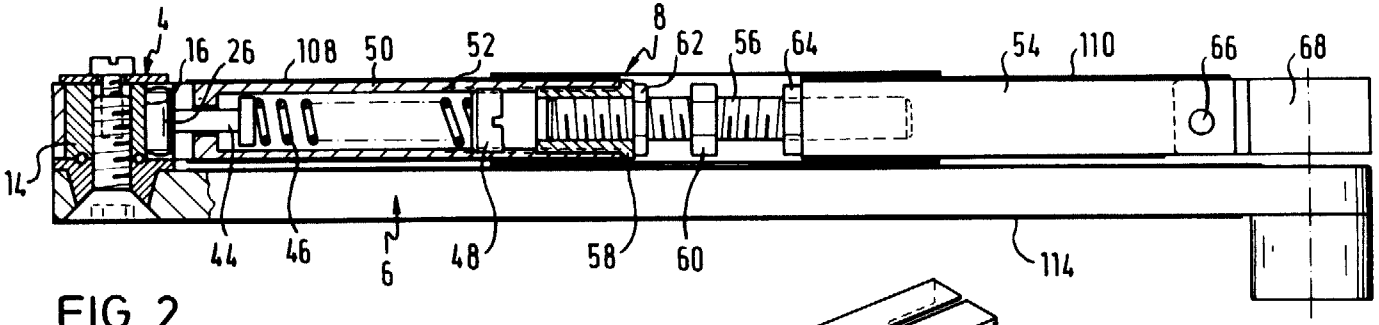
FIG. 2 is a partial sectional view taken through the device of FIG. 1 as viewed in the direction of the arrow II.

Referring now to the drawings, and particularly to FIGS. 1-3 wherein like reference numerals are used to identify similar parts, there is shown an embodiment of the present invention which consists of a door control mechanism 2 which is shown holding a door 10 in the open position. The control mechanism 2 includes two longitudinal bars 6 and 8 which are connected together at their free ends by a hinge assembly 4. The opposite ends of the bars 6, 8 are hinged, respectively, to the door 10 and to a door frame 12 in a manner known per se.

The bar 6 is shown in solid line in the position which it occupies when the door 10 is held in the open position, and in broken line form in the position it would occupy when the door is in the closed position.

The hinge assembly 4 includes a hinge pin 14 which is affixed with the bar 6. The hinge pin 14 is provided with a flattened area 16 and with locking recesses 18, 20, 22, and 24 which are located symmetrically relative to the flattened area 16. The locking recesses 18, 20, 22, and 24 are provided to enable utilization of the control assembly 2 with doors which swing in opposed directions, and with a given door arrangement, two of the locking recesses will be utilized in such an arrangement.

In the bar 8 there is provided a locking element 26 which is under a spring pressure and which engages at the flattened area 16 when the door is closed, and the spring is relaxed, or which engages into one of the locking recesses 18, 20, 22, and 24 when the door is in the opened position.

The locking element 26 is shown as a cylindrical member and the recesses 18, 20, 22, and 24 are accordingly shown to be formed as hollow cylindrical recesses.

Other structural arrangements within the scope of the invention are contemplated and instead of the arrangement depicted in the drawings, a ball locking mechanism may be provided wherein the locking elements may be spherical and the locking recesses may accordingly be formed as hollow spherical recesses.

The locking recesses 18 and 22 are assigned to the opening position of the door at approximately 90 degrees, and the locking recesses 20, 24 to an opening position of the door of about 170 degrees. The edges 28, 30, 32, and 34 defined at the terminations of the locking recesses 18, 20, 22, and 24 in the opening direction are rounded off and formed with a larger radius of curvature than edges 36, 38, 40, and 42 which define the terminations of the locking recesses 18, 20, 22, and 24 toward the closing direction of the door. Therefore, the locking mechanism, as a result of the differences in radius of curvature of the aforementioned edges, operates to make it more difficult to move the door in the closing direction than in the opening direction.

The locking element 26 is arranged under the pressure of a plunger 44 upon which a helical spring 46 acts. The helical spring 46 is in turn supported at an adjusting screw 48. The plunger 44 and the helical spring 46 are enclosed in a cylinder 50 which has internal threads 52 for the screw 48. The cylinder 50 is open on the side from which access to the screw 48 must be provided and the cylinder forms a first part or section of the bar 8. A second section 54 of the bar 8 is connected with the first section formed by the cylinder 50 by means of a double ended adjusting screw 56 which engages into a threaded bushing 58 in the section 50 and a second threaded bushing (not shown) in section 54. The threads on the two ends of the adjusting screw 56 are oppositely directed so that by rotation of the adjusting screw 56 while it is held at a hexagonal element 60 located at the center thereof, the distance of the sections 50, 54 may be adjusted to local conditions. The positions of the sections 50, 54 are fixed by tightening of check nuts 62, 64.

At the end of the section 54 facing the door frame 12, a lug or eye 68 is hinged which is pivotable about a horizontal axle 66.

Figure 4:
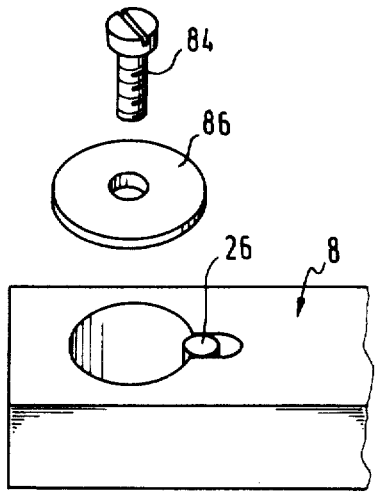
FIG. 4 is an exploded view of a hinge assembly utilized with the present invention.
Figure 4:
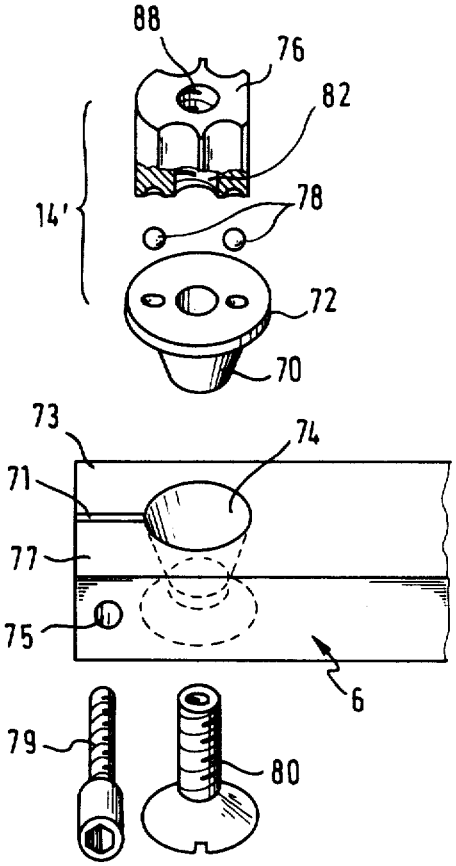

FIG. 4 shows an embodiment of a hinge assembly which may be formed in two parts. In the embodiment of FIG. 4, a hinge assembly 14' is formed to include a conical cap member 70 having an annular flange 72 which is inserted into a conical recess of the bar 6 and a hinge pin 76 which is constructed in accordance with the hinge pin 14 shown in FIG. 3.

The hinge pin 76 is to be connected with the cone 70 and to be secured against rotation relative thereto by means of coupling balls 78. The connection is formed by means of a screw 80 which is inserted from the bottom into the bar 6 and which engages in an internal thread 82 of the hinge pin. In order to secure the bar 8 at the hinge assembly 14', a screw 84 is provided which extends through an annular disc 86 and engages from above into an internal thread 88 in the hinge pin 76.

By loosening and then again tightening the screw 80, the hinge pin 76 may be fixed in a desired angular position relative to the bar 6. However, the angular positions of the hinge pin 76 relative to the bar 6 are not fixed in a permanent manner.

Figure 5:
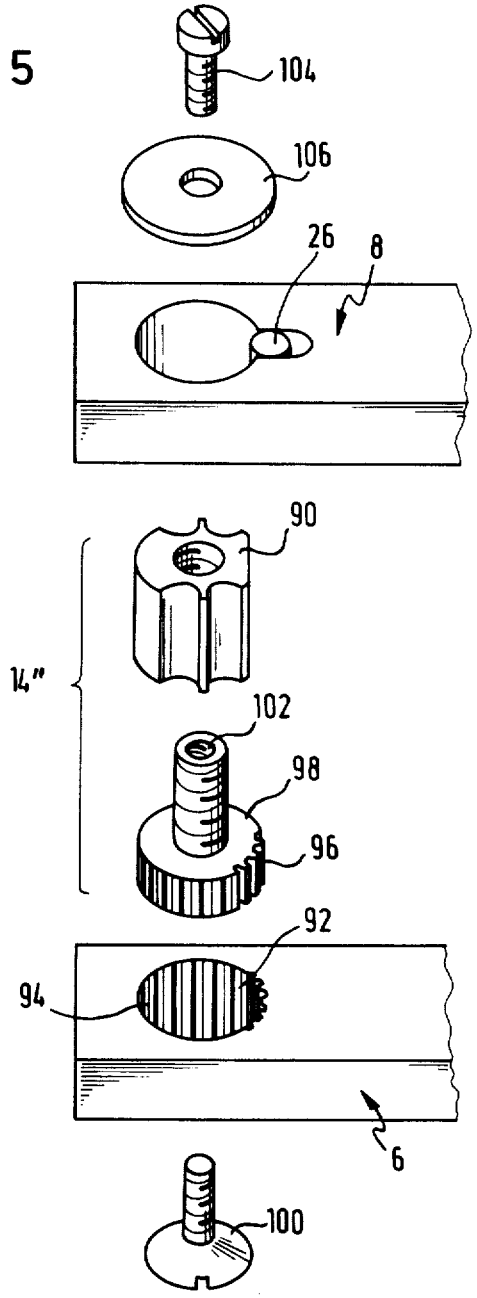
FIG. 5 is an exploded view of another embodiment of a hinge assembly.

In the embodiment in accordance with FIG. 5, a locking affixation of a hinge pin 90 of the hinge assembly 14'' in different angular positions is possible.

For this purpose, a bore 92 with a longitudinal tooth construction 94 is provided in the bar 6. A corresponding external longitudinal tooth construction 96 formed at a mounting 98 for the hinge pin may be inserted in the bore in a desired angular position. The hinge pin 90 and the mounting 98 may be constructed in one piece. In the embodiment shown, the hinge pin 90 may be screwed onto the mounting 98 and a screw 100 which corresponds with the screw 80 shown in FIG. 4 engages in an internal thread 102 of the mounting 98 and holds the mounting firmly on the bar 6. The bar 8 is secured at the hinge pin 90 by means of a screw 104 and an annular disc 106 in a manner similar to that shown in FIG. 4.

Referring again to the embodiment shown in FIG. 4, the bar 6 includes a slot 71 which begins at the free end thereof and reaches to the conical recess 74. The section 73 of the bar 6 which is defined by the slot 71 is formed with an internal thread and a screw 79 may be secured into this internal thread through a bore 75 in the other section 77 defined by the slot 71. The sections 73 and 77 may be pulled apart by means of the screw 79. In this manner, the conical member 70 may be secured against rotation.

During assembly the door control mechanism with the bars 6 and 8, the assembly may proceed in the usual manner while the cone 70 is loose wherein the locking element 26 is located in that locking recess 18, 20, 22, 24 which corresponds to the desired opening position of the door. Then the door is swung into a desired open position and the screw 79 is tightened. It is then ensured that the door in its open position will again automatically take up the desired angular position with respect to its frame during subsequent opening.

Figure 6:
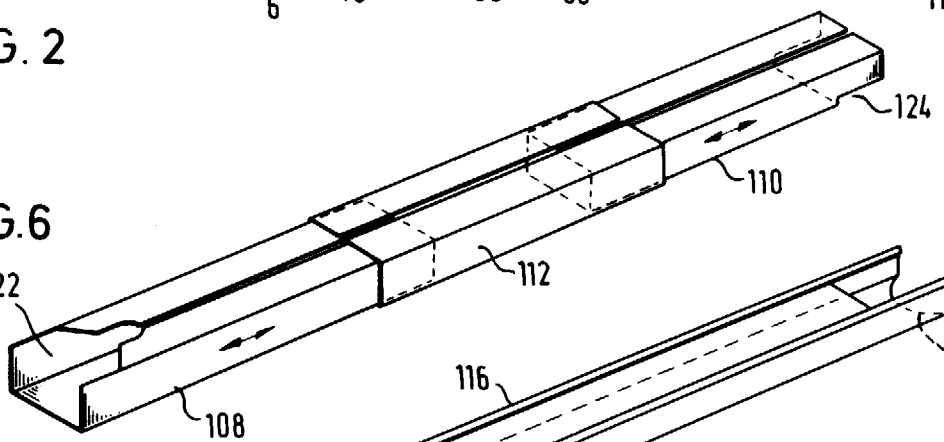
FIGS. 6 and 7 are perspective views showing casing elements for the bars of the door control mechanism of the invention.

In FIG. 6 there is shown a cover device which includes two longitudinally slit casings 108, 110 which can be pushed over the separated sections 50 and 54 and which will then cover the bar 8 up to the end thereof and particularly up to the hinge assembly 4. In order to cover the region between the casings 108 and 110, a somewhat wider longitudinally slit casing 112 is provided in order to slide over the casings 108 and 110.

Figure 7:
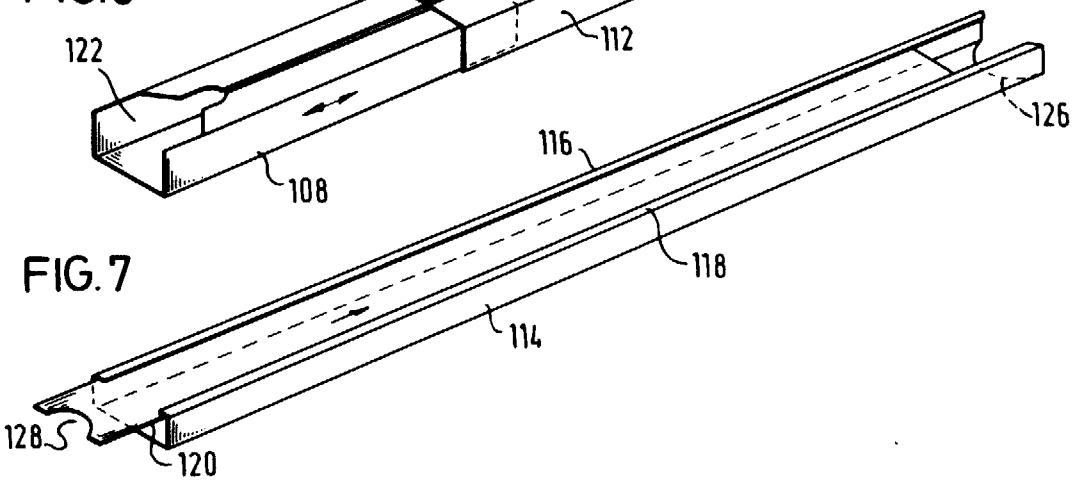

The bar 6 may be enclosed by a covering member 114 shown in FIG. 7 which is pushed on and which has a cross section which is U-shaped with edges 116, 118 which are inwardly bent. Below the edges 116, 118 a covering strip 120 is inserted. Recesses 122, 124, 126, and 128 in the members 110 and 114, respectively, operate to enable the members to cover the bars 6, 8 to the fullest extent possible up to the areas of pivotal connections and up to the hinge assembly 4.

While specific embodiments of the invention have been shown and described in detail to illustrate the application of the inventive principles, it will be understood that the invention may be embodied otherwise without departing from such principles.

What is claimed is:

1. A control mechanism for a door hinged on a door frame operative to hold said door in an open position comprising a first and a second longitudinal bar each having a pair of ends, hinge means joining together one of the ends of each of said bars with the other ends of said bars being hinged, respectively, to said door and to said frame, said hinge means comprising a hinge pin affixed to said first bar, at least one recess formed in said hinge pin, a locking element on said second bar adapted to engage within said recess and spring means urging said locking element into engagement with said recess, at least one of said longitudinal bars being formed in two sections which are connected together by means of a double ended adjusting screw having oppositely directed threads with check nuts being provided to enable affixation in a desired position of said two sections relative to each other.

2. A mechanism according to claim 1 which is constructed so as to be more difficult to operate in the closing direction of said door than in the opening direction thereof.

3. A mechanism according to claim 1 wherein said hinge pin is formed to include a flattened area adapted to be engaged by said locking element with at least two locking recesses being arranged symmetrically on opposite sides of said flattened area.

4. A mechanism according to claim 1 wherein said spring means is formed as a helical spring and wherein there is provided an adjustable abutment supporting said helical spring.

5. A mechanism according to claim 1 wherein each of said longitudinal bars is provided with casing elements enclosing said longitudinal bars up to said hinge means, said casing elements being adapted to be placed over said bars.

6. A control mechanism for a door hinged on a door frame operative to hold said door in an open position comprising: a first and a second longitudinal bar each having a pair of ends; a hinge assembly joining together one of the ends of each of said bars with the other ends of said bars being hinged, respectively, to said door and to said frame; said hinge assembly comprising a hinge pin formed with at least one locking recess detachably fastened to said first bar in one of a plurality of different angular positions so as to be secured against rotation relative thereto, a locking element on said second bar adapted to engage within said recess, spring means urging said locking element into engagement with said recess, a cap member fastened to said first bar and secured against rotation relative thereto in each of said different angular positions, said hinge pin being fastened to said cap member so as to be non-rotatable relative thereto, internal threads formed in said hinge pin, a first screw extending through said cap member and engaging into said internal threads securing said cap member to said first bar and a second screw engaging into said internal threads for connecting said second bar with said hinge assembly.

* * * * *